US011075038B2

(12) United States Patent
Plato et al.

(10) Patent No.: US 11,075,038 B2
(45) Date of Patent: Jul. 27, 2021

(54) FASTENING TOOL HAVING AN ERGONOMIC TRIGGER

(71) Applicant: Black & Decker, Inc., New Britain, CT (US)

(72) Inventors: Barry Plato, Bel Air, MD (US); Lee M. Brendel, Bel Air, MD (US)

(73) Assignee: Black & Decker, Inc., New Britain, CT (US)

( * ) Notice: Subject to any disclaimer, the term of this patent is extended or adjusted under 35 U.S.C. 154(b) by 102 days.

(21) Appl. No.: 15/802,855

(22) Filed: Nov. 3, 2017

(65) Prior Publication Data

US 2018/0130620 A1 May 10, 2018

Related U.S. Application Data

(60) Provisional application No. 62/417,691, filed on Nov. 4, 2016.

(51) Int. Cl.

| | |
|---|---|
| ***H01H 21/04*** | (2006.01) |
| ***B25F 5/02*** | (2006.01) |
| *H01H 3/20* | (2006.01) |
| *H01H 9/06* | (2006.01) |

(52) U.S. Cl.

CPC ..... *H01H 21/04* (2013.01); *B25F 5/02* (2013.01); *H01H 3/20* (2013.01); *H01H 9/06* (2013.01)

(58) Field of Classification Search

CPC ..... H01H 3/04; H01H 3/122; H01H 3/20; H01H 9/06

USPC ..... 173/170

See application file for complete search history.

(56) References Cited

U.S. PATENT DOCUMENTS

| | | | | |
|---|---|---|---|---|
| 1,516,660 | A | 11/1924 | Beach | |
| D183,070 | S | 6/1958 | Stillson | |
| D191,635 | S | 10/1961 | Ustin | |
| 5,236,129 | A * | 8/1993 | Grime | B05B 7/1218 239/528 |
| 5,588,495 | A | 12/1996 | Dear et al. | |
| 5,767,502 | A * | 6/1998 | Ferland | G06K 7/10881 200/343 |
| 5,965,095 | A * | 10/1999 | Owens | B01D 53/64 423/210 |
| 6,120,362 | A | 9/2000 | Etter et al. | |
| 6,158,624 | A * | 12/2000 | Grigg | B05B 12/0022 222/145.6 |
| 6,609,322 | B1 * | 8/2003 | Michelson | A61B 17/2909 42/7 |
| 8,146,824 | B2 * | 4/2012 | Drzymala | G06K 7/10881 235/462.48 |
| 8,444,035 | B2 | 5/2013 | Coleman, Jr. | |
| 9,259,832 | B2 | 2/2016 | Miyazawa et al. | |
| 2005/0161535 | A1 | 7/2005 | Cizowski et al. | |

(Continued)

*Primary Examiner* — Michelle Lopez

(74) *Attorney, Agent, or Firm* — Rhonda Barton

(57) ABSTRACT

A fastening tool including a housing having a handle portion, a base for releasably mounting a power source, a nosepiece for driving fasteners into a workpiece, a magazine for feeding successive fasteners into the nosepiece, and a trigger. The trigger is configured to activate a trigger switch and initiate a fastener driving sequence. The trigger has a proximal end pivotably connected to a handle body and a distal free end adjacent to the base. The distal free end of the trigger has a curved body that extends substantially parallel to the magazine.

9 Claims, 5 Drawing Sheets

(56) References Cited

U.S. PATENT DOCUMENTS

| | | | | |
|---|---|---|---|---|
| 2008/0073403 | A1* | 3/2008 | Cho | B25C 1/008 227/8 |
| 2009/0104861 | A1 | 4/2009 | Van Der Linde et al. | |
| 2013/0213679 | A1 | 8/2013 | Miyazawa et al. | |

* cited by examiner

FASTENING TOOL HAVING AN ERGONOMIC TRIGGER

CROSS-REFERENCE TO RELATED APPLICATIONS

The present application claims priority under 35 U.S.C. § 119 to U.S. Provisional Application Ser. No. 62/417,691 entitled Paddle Trigger filed on Nov. 4, 2016, which is wherein incorporated by reference in its entirety.

BACKGROUND OF THE INVENTION

Field of the Invention

The present invention relates to the field of fastening tools. In particular, the present invention relates to a fastening or a driving tool, such as a nailer, and more particularly to improvements in a flooring nailer having an ergonomic trigger.

Description of the Related Art

Fastening tools for driving fasteners such as nails, staples or the like are commonly used in industry and commerce. The fasteners are generally supplied from a collated strip of fasteners disposed in a magazine coupled to a nosepiece portion of the fastening tool. Many users of trigger-operated fastening tools turn the tool backwards or in a reverse position during the course of operation. However, effectively reaching the trigger with the tool turned backwards creates an operational discomfort. Specifically, the fastening tools that are available may not provide the user with a desired degree of flexibility and freedom of operation due to the location and/or configuration of the trigger member.

SUMMARY OF THE INVENTION

A fastening tool that drives a fastener into a workpiece includes a paddle trigger in the form of an ergonomic trigger. In an embodiment, the paddle trigger has a lever or paddle portion on or as part of a trigger body. The paddle portion allows the user to hold the fastening tool backwards or in a reverse manner and depress the trigger with one or a plurality of fingers so as to maintain control over the fastening tool in a comfortable and ergonomic manner.

In an embodiment, the fastening tool includes a housing, a nosepiece assembly, a base for releasably mounting a power source, a magazine assembly coupled to at least one of the nosepiece and the housing and configured to hold and sequentially feed fasteners to the nosepiece. A handle having a handle body is arranged between the housing and the base. A trigger switch is arranged within the handle body and a trigger is configured to activate the trigger switch. The trigger has a proximal end pivotably connected to the handle body and a distal free end adjacent to the base. The distal free end has a curved body and extends substantially parallel to the magazine.

In an embodiment, the trigger can have a shape that corresponds to the shape of the handle body and extends substantially the length of the handle body.

In an embodiment, the handle has a handle forward surface that faces the magazine assembly. The trigger has a trigger forward surface and an opposing trigger rearward surface that faces the handle forward surface. The trigger forward surface and the trigger rearward surface have a shape that complements the shape of the handle forward surface.

In an embodiment, when the trigger is depressed, the trigger rearward surface engages the handle body in a substantially flush manner. In an embodiment, when the trigger is depressed, the distal free end of the trigger engages the handle body in a substantially flush manner.

In an embodiment, depressing the trigger at the distal free end activates the trigger switch.

In an embodiment, the trigger has a U-shaped cross section and a longitudinally undulating curvature.

In an embodiment, the trigger can be depressed in a first configuration and a second configuration of a user's hand. In a first configuration, a user's hand engages the trigger in a first position, and in a second configuration, the user's same hand engages the trigger in a second position that is different from the first position.

In a further embodiment, the trigger can be depressed in a first configuration and a second configuration of a user's hand. In a first configuration, a user's fingers can be arranged with a thumb adjacent to the housing, and in a second configuration, the user's fingers of the same hand can be arranged with the thumb adjacent to the base.

In an embodiment, the magazine can be substantially parallel to the handle body and the base can be substantially parallel to the nosepiece.

BRIEF DESCRIPTION OF THE DRAWINGS

The present invention in its several aspects and embodiments solves the problems discussed above and significantly advances the technology of fastening tools, such as cordless nailers. The present invention can become more fully understood from the detailed description and the accompanying drawings, wherein.

DETAILED DESCRIPTION OF THE INVENTION

The present invention relates to a trigger arrangement for a portable hand-operated power tool. More particularly, the present invention relates to fastening tool having a trigger that is contoured to correspond to the shape of the handle and a user's grasp that can be activated by the user's hand in an ergonomic manner in non-conventional tool orientations. Accordingly, the user is able to ergonomically position one or more fingers in a multiple ambidextrous holding positions around the trigger to actuate the tool.

Figure 1A:
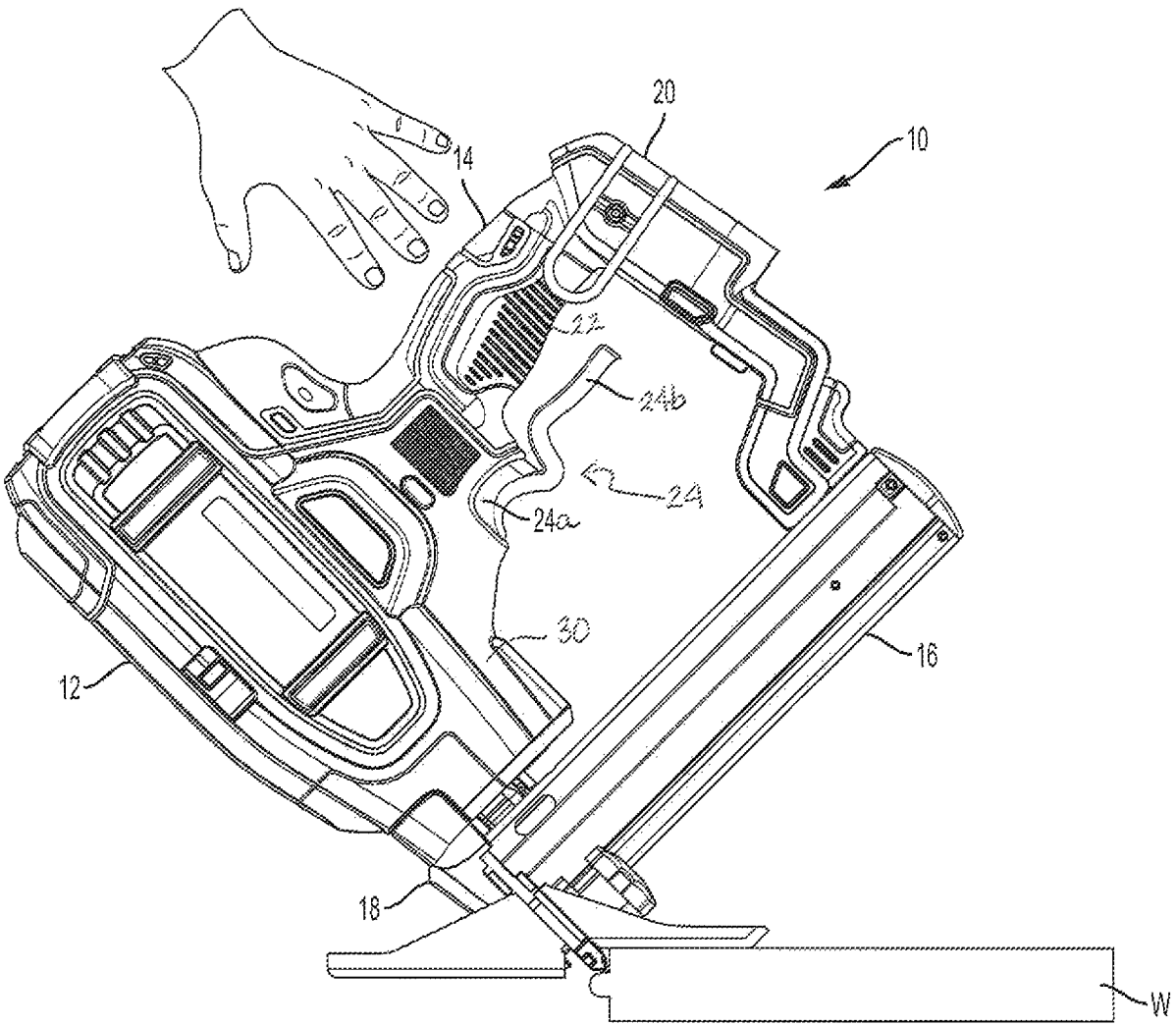
FIGS. 1A and 1B are side views of a fastening tool having the trigger in the deactuated position.
Figure 1B:
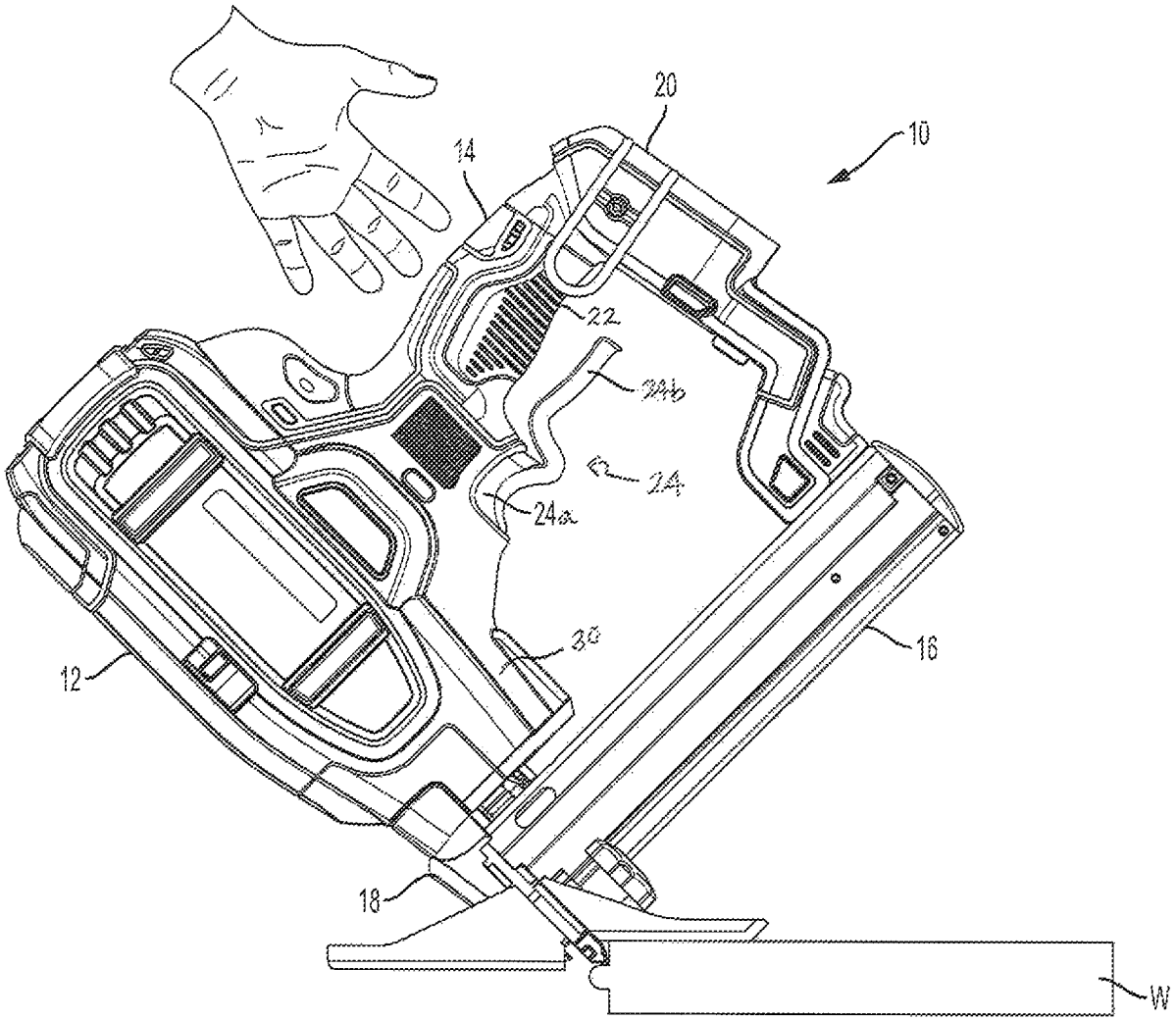

With reference to FIGS. 1A and 1B of the drawings, a fastening tool constructed in accordance with the teachings of the present invention is generally indicated by reference numeral 10. The fastening tool 10 includes a housing 12 having a handle 14 extending from the housing and base 20 to which a battery pack (not shown) may be releasably coupled. The handle 14 is arranged between an upper portion 30 of the housing 12 and the base 20. The fastening tool 10 also includes a magazine assembly 16, a nosepiece assembly 18 and a trigger 24.

The magazine assembly is coupled to at least one of the nosepiece assembly 18 and the housing 12 and is configured to hold and sequentially feed fasteners to the nosepiece assembly 18. The nosepiece assembly 18 defines a fastener drive track through which fasteners, such as nails, are driven. The nosepiece assembly 18 extends forward of and is connected to the housing 12. In an embodiment, the nosepiece assembly 18 is constructed and arranged within the fastening tool 10 and engages the workpiece at an oblique angle. In the illustrated embodiments, the nosepiece 18 is constructed and arranged within a flooring tool to engage the workpiece at a 45-degree angle. In alternative embodiments, the nosepiece 18 can be constructed and arranged to engage a workpiece at any angle.

Figure 2:
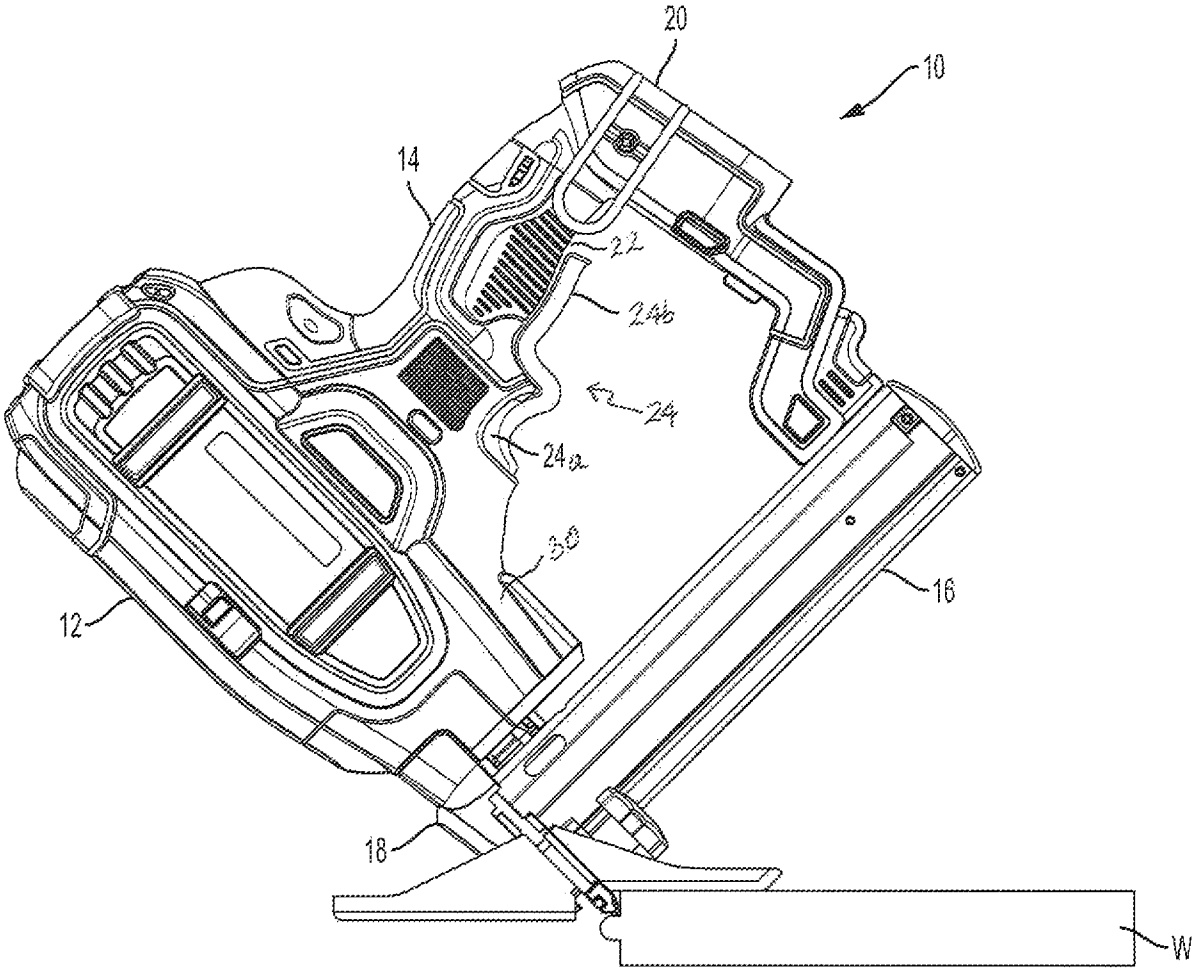
FIG. 2 is a side view of the fastening tool having the trigger in the actuated position.

The handle 14 has a handle body 22 that extends between the upper portion 30 of the housing 12 and the base 20. As shown in FIGS. 1A-2, the handle 14 may extend substantially perpendicularly from the upper portion 30 of the housing. The handle body 22 is configured to be received by a user's hand, thereby making the fastening tool 10 portable. The housing 12 may be constructed from a lightweight yet durable material, such as magnesium and the handle may be overmolded with a grip-enhancing polymeric material.

A battery pack provides power to the motor (not shown) such that fastening tool 10 can drive one or more fasteners held by the magazine assembly 16. The magazine assembly 16 can also be releasably engaged with the base 20 and optionally be coupled to the housing 12 between the nosepiece assembly 18 and the base 20. As shown in FIGS. 1A-2, the magazine assembly 16 is substantially parallel to the handle and the base 20 is substantially parallel to the nosepiece 18.

While the fastening tool 10 is illustrated as being electrically powered by a suitable power source, such as a battery pack, those skilled in the art will appreciate that the invention, in its broader aspects, may be constructed somewhat differently and that aspects of the present invention may have applicability to pneumatically powered driving tools. Furthermore, while aspects of the present invention are described herein and illustrated in the accompanying drawings in the context of a nailer, those of ordinary skill in the art will appreciate that the invention, in its broadest aspects, has further applicability. For example, the trigger 24 may also be employed in various other mechanisms that use hand-operated actuating mechanisms.

The trigger 24 may be coupled to the housing 12 at the handle body 22 and is configured to receive an input from the user, typically by way of the user's fingers. The trigger 24 activates a trigger switch 26 to generate a trigger signal that may be employed in whole or in part to initiate the cycling of the fastening tool 10 to drive a fastener into a workpiece W.

The trigger 24 is mounted to an interior 32 of the handle body 22 and extends through the exterior 34 of the handle body. As shown in FIGS. 1A and 1B, in a resting state, the trigger 24 is biased into an extended or deactuated position in a direction away from the handle 14. As shown in FIG. 2, the trigger 24 can be moved into a retracted or actuated position against the handle 14. The user can move (i.e., pivot and/or translate) the trigger 24 into the actuated position by depressing the trigger with one or more fingers. When the trigger 24 is in the retracted or actuated position, the trigger 24 can engage the trigger switch 26 and activate the trigger switch 26 to generate a trigger signal. When the trigger 24 activates the trigger switch 26, the trigger can initiate the cycling of the fastening tool 10 to drive a fastener into a workpiece W. In the various configurations, the trigger switch 26 can be any suitable type of switch including, but not limited to, a micro switch.

As illustrated in FIGS. 1A, 1B, 2 and 3, the trigger 24 has an upper portion 24*a* and a lower portion 24*b*. The upper portion 24*a* has a width around which a finger can be bent, and a lower portion 24*b* has the same width as the upper portion 24*a* and also has a length along which at least one or a plurality of fingers of the same hand can be bent. The upper portion 24*a* of the trigger 24 is proximal to the upper portion 30 of the housing 12 and is pivotably connected to the handle body 22 about a pivot boss 28 (FIG. 4). The pivot boss 28 is integrally formed in the interior portion 32 of the handle 14. The trigger 24 is configured to be pivotable substantially in the forward-rearward direction, toward and away from a workpiece W about the pivot boss 28 by a predetermined angle. In the forward direction, the trigger is in the deactuated position and in the rearward direction the trigger is in the actuated position.

The lower portion 24*b* of the trigger 24 extends along the length of the handle 14*a* and includes a free end that is distal from the housing 12 and closer to the base than the upper portion 24*a* of the trigger. Depressing the trigger 24 by the distal free end or lower portion 24*b* also allows the trigger to pivot substantially in the forward-rearward direction, toward and away from a workpiece W about the pivot boss 28 by a predetermined angle. As such, depressing the trigger 24 by either the upper portion 24*a* or the lower portion 24*b* results in the same movement of the trigger and activation of the trigger switch 26.

In an alternative embodiment, depressing the trigger 24 either by the upper portion 24*a* or by the lower portion 24*b*, can linearly translate the trigger to engage with and activate the trigger switch 26.

Figure 3:
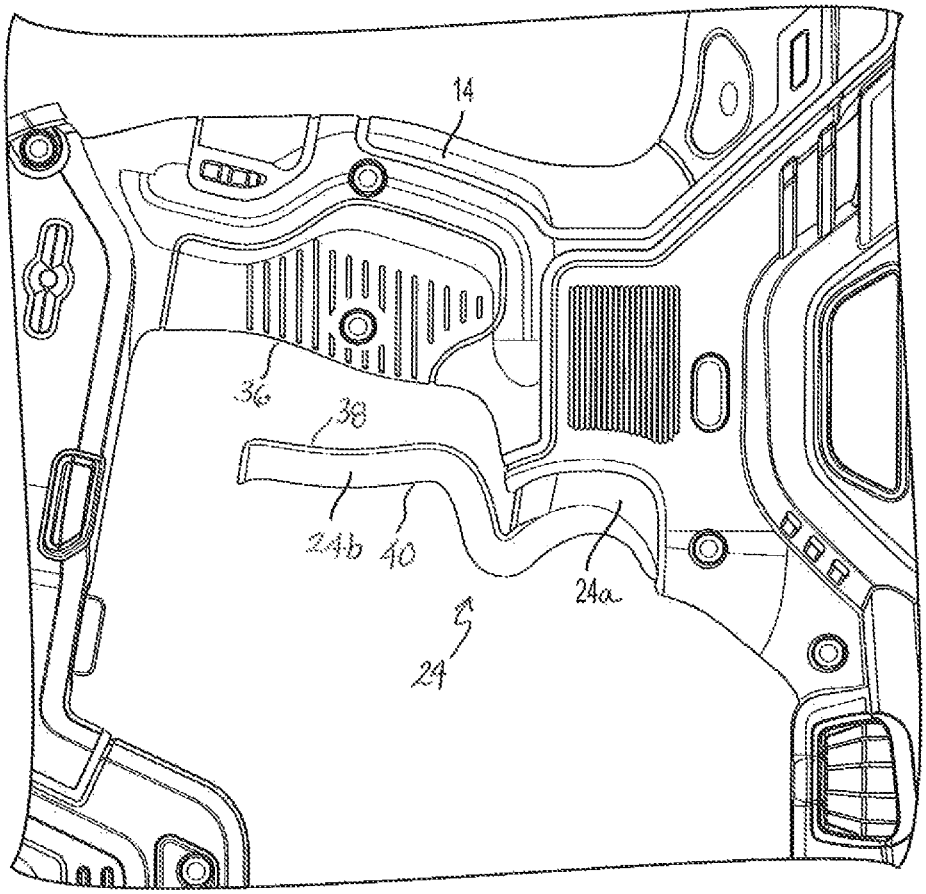
FIG. 3 is an enlarged view of the trigger.
Figure 4:
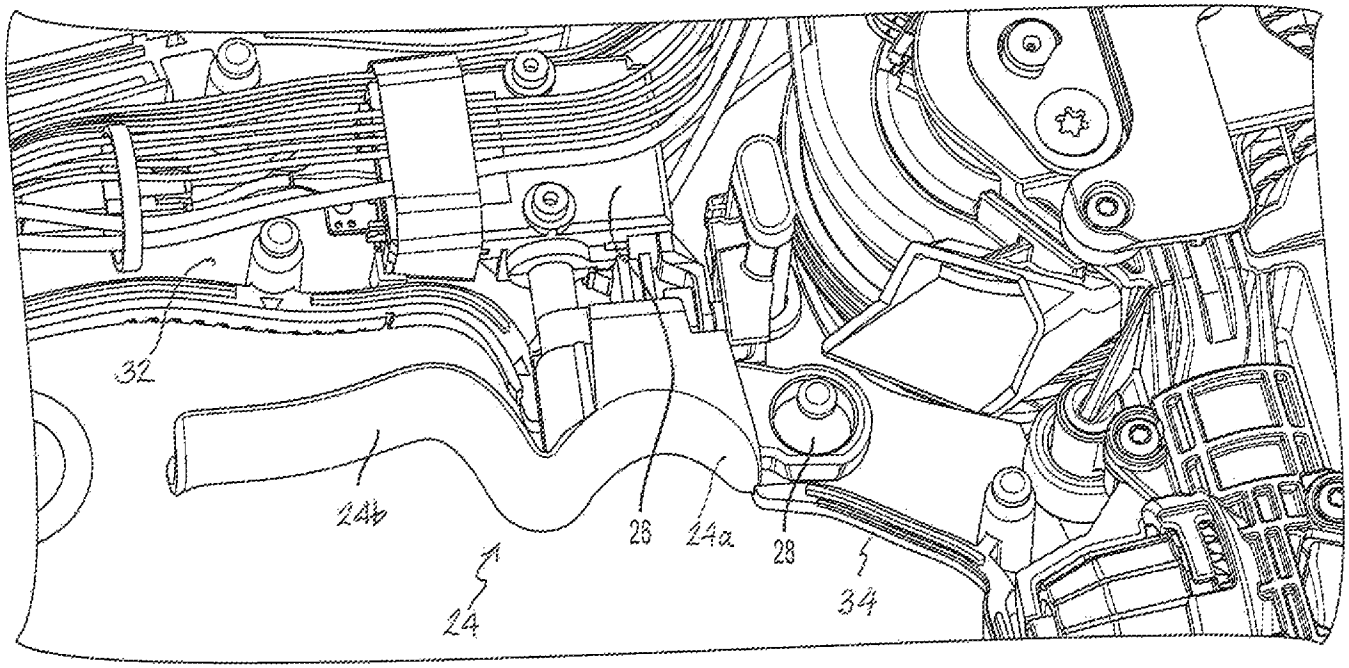
FIG. 4 is a cutaway drawing showing the spatial arrangement of the trigger in the handle of the fastening tool.

As illustrated in FIG. 3, a forward surface 36 of the handle body 22 that faces the magazine is ergonomically contoured to the grasp of a user's hand. Likewise, the forward surface 38 of the lower portion 24*b* of the trigger 24 that also faces the magazine assembly 16, is similarly contoured to the grasp of a user's hand. In an embodiment, a rearward surface 40 of the lower portion 24*b* of the trigger 24 that faces the handle body 22, has a shape that identically complements the forward surface 36 of the handle body 22. As a result, when the trigger 24 is depressed or retracted, the rearward surface 40 of the trigger can engage the forward surface 36 of the handle body 22 in a substantially flush manner.

In an embodiment, the lower portion of the trigger 24*b* has a U-shaped cross-section and a longitudinally undulating curvature. Alternatively, the lower portion 24*b* of the trigger can have any cross-sectional shape that conforms to the natural ergonomic grip angles of a user's hand. Additionally, the upper and lower portions 24*a*, 24*b* of the trigger 24, together, have a length that accommodates four of a typical user's fingers.

In operation, in a first configuration of a user's hand, the trigger can be depressed by the user's hand in a first position. The first position can be a position in which the user's thumb is adjacent to the housing 12, the index finder is on the upper portion 24*a* of the trigger 24, and the palm of the user's hand is pressed against a lateral side of the handle 14. In a second configuration of the user's hand, the trigger 24 can be depressed by the user's same hand in a second position that is different from the first position. The second position can be a position in which the user's thumb is adjacent to the base 20, at least one or all four fingers of the user's hand are in contact with the trigger 24 and the palm of the user's hand is pressed against an opposite lateral side of the handle 14.

When the trigger 24 is moved to the actuated position, such as shown in FIG. 2, the trigger can be pressed against the exterior surface of the tool handle 14. In order to improve the ergonomic feel of the trigger activation process, the trigger is designed to conform to the shape or contour of the tool handle and contoured to the grasp of a user's hand in both of the first configuration and the second configuration.

Thus, the trigger 24 is configured for the user to be able to press the trigger from any position in which the fastening tool is held.

The trigger in its numerous and varied embodiments herein can be used on any trigger-operated fastening tool including, but not limited to a cordless or battery powered tool. The trigger provides an increased surface area to activate the trigger switch. As a result, the fastening tool having the ergonomic trigger provides a superior feel and ease of use in non-conventional orientations over existing trigger designs.

While aspects of the present invention are described herein and illustrated in the accompanying drawings in the context of a fastening tool, those of ordinary skill in the art will appreciate that the invention, in its broadest aspects, has further applicability.

It will be appreciated that the above description is merely exemplary in nature and is not intended to limit the present disclosure, its application or uses. While specific examples have been described in the specification and illustrated in the drawings, it will be understood by those of ordinary skill in the art that various changes may be made and equivalents may be substituted for elements thereof without departing from the scope of the present disclosure as defined in the claims. Furthermore, the mixing and matching of features, elements and/or functions between various examples is expressly contemplated herein, even if not specifically shown or described, so that one of ordinary skill in the art would appreciate from this disclosure that features, elements and/or functions of one example may be incorporated into another example as appropriate, unless described otherwise, above. Moreover, many modifications may be made to adapt a particular situation or material to the teachings of the present disclosure without departing from the essential scope thereof. Therefore, it is intended that the present disclosure not be limited to the particular examples illustrated by the drawings and described in the specification as the best mode presently contemplated for carrying out the teachings of the present disclosure, but that the scope of the present disclosure will include any embodiments falling within the foregoing description and the appended claims.

We claim:

1. A fastening tool comprising:

a housing;

a nosepiece;

a base for releasably mounting a power source;

a magazine assembly coupled to at least one of the nosepiece and the housing and configured to hold and sequentially feed fasteners to the nosepiece;

a handle having a handle body, the handle being arranged between the housing and the base;

a trigger switch arranged within the handle body, and having a trigger stem; and trigger configured to engage the trigger stem to activate the trigger switch, the trigger having a proximal end pivotably connected to the handle body and a distal free end adjacent to the base, the distal free end having a curved body and extending substantially parallel to the magazine assembly, wherein the trigger has a first concave portion on a first side of the trigger stem that is configured to accommodate gripping by one or more fingers of an operator and a second concave portion on a second side of the trigger stem that is configured to accommodate gripping by one or more fingers of the operator, wherein the first concave portion and the second concave portion are separated by a convex portion, and wherein, when the trigger switch is activated, the trigger engages the handle body in a substantially flush manner.

2. The fastening tool according to claim 1, wherein the trigger has a shape that corresponds to the shape of the handle body and extends substantially the length of the handle body.

3. The fastening tool according to claim 1, further comprising a handle forward surface and a trigger rearward surface, wherein the handle forward surface faces the magazine assembly, wherein the trigger rearward surface faces the handle forward surface, and wherein the trigger rearward surface has a shape that complements the shape of the handle forward surface.

4. The fastening tool according to claim 3, wherein in a depressed state, the trigger rearward surface engages the handle forward surface in the substantially flush manner.

5. The fastening tool according to claim 1, wherein the distal free end of the trigger in a depressed state engages the handle body in a substantially flush manner.

6. The fastening tool according to claim 1, wherein depressing the trigger at the distal free end activates the trigger switch.

7. The fastening tool according to claim 1, wherein the trigger has a U-shaped cross section and a longitudinally undulating curvature.

8. The fastening tool according to claim 1, wherein the magazine is substantially parallel to the handle body.

9. The fastening tool according to claim 1, wherein the base is substantially parallel to the nosepiece.

* * * * *